United States Patent [19]

Rosenzweig

[11] 4,170,053

[45] Oct. 9, 1979

[54] DRAPERY PLEATER HOOK

[76] Inventor: Philip Rosenzweig, 23119 Riverside Dr., Southfield, Mich. 48034

[21] Appl. No.: 853,323

[22] Filed: Nov. 21, 1977

[51] Int. Cl.[2] ..... A44B 13/00; A47H 13/14

[52] U.S. Cl. ..... 24/84 R; 24/73 CH; 160/348

[58] Field of Search ..... 160/348; 24/73 CH, 81 DS, 24/84 C, 84 FH, 84 R, 85 C; 16/87.2

[56] References Cited

U.S. PATENT DOCUMENTS

| | | | |
|---|---|---|---|
| 2,623,582 | 12/1952 | Handley | 160/348 |
| 2,633,321 | 3/1953 | Coulter | 160/348 |
| 2,754,903 | 7/1956 | Czetli et al. | 160/348 |
| 3,103,247 | 9/1963 | Rosenzweig | 160/348 |
| 3,191,665 | 6/1965 | Rosenbaum et al. | 160/348 |

FOREIGN PATENT DOCUMENTS

| | | | |
|---|---|---|---|
| 1155217 | 10/1963 | Fed. Rep. of Germany | 160/348 |

*Primary Examiner*—Kenneth J. Dorner
*Attorney, Agent, or Firm*—Barnes, Kisselle, Raisch & Choate

[57] ABSTRACT

A drapery pleater hook has four fingers adapted to be inserted in the tunnels of a pleater tape affixed to the upper end of a drapery panel. The hook includes a pleat pincher disposed below the fingers. The pleat pincher has a pair of arms swingable from an open position to a closed, pleat-pinching position and a means for releasably locking the arms in the closed position.

16 Claims, 11 Drawing Figures

DRAPERY PLEATER HOOK

This invention relates to a drapery pleater hook of the type adapted to be used with drapery provided with a pleater tape along the upper edge thereof.

One form of drapery commonly used has a pleater tape sewn along the upper edge thereof, the tape being a fabric strip fashioned with downwardly opening pockets or tunnels spaced laterally of the strip at regular intervals. Draperies of this type are suspended from a conventional drapery rod by means of pleater hooks which normally have four laterally spaced, upright fingers. The upper portion of the drapery is manually gathered together and the fingers of the hook are inserted upwardly into the pockets or tunnels of the pleater tape to form a pleat having three vertical folds.

Pleater hooks of the type described are frequently constructed to impart a desired pinched appearance to the lower end of the pleat with the folds flaring outwardly and upwardly from the pinched lower section thereof in an effort to simulate a custom-made pleat. However, such hooks as heretofore manufactured have serious shortcomings; none of the pleater hooks presently being sold are capable of producing a pleat which actually gives the impression and appearance of a custom-made pleat. For the most part, conventional hooks are not capable of producing a sufficiently tight pinch at the lower end of the pleat which faithfully simulates a custom-sewn pinch pleat. Furthermore, when the hook is designed to produce a relatively tight pinch, it becomes extremely difficult to assemble the hook with the pleater tape.

The primary object of this invention is to provide a pleater hook which overcomes the above-mentioned problems associated with conventional pleater hooks and which, nevertheless, produces a pleat which has the appearance of an authentic custom-made pleat.

More specifically, it is an object of this invention to provide a pleater hook construction which includes a pleat pinching attachment in the form of a clamp or the like having a pair of pleat pinching grippers adapted to assume an open position to facilitate insertion of the pleater hook fingers upwardly into the pockets of the pleater strip and to be thereafter locked in a closed position to tightly grip the folds of the fabric and thereby produce a pleat having a tightly pinched section at the lower end thereof with the folds of the pleat flaring outwardly and upwardly from the pinched section in the manner of a truly custom-made plate. The pleater hook of this invention is similar in some respects to conventional pleater hooks in that it includes four laterally-spaced fingers for insertion into the tunnels or pockets of the pleater tape. However, unlike conventional pleater hooks, in the present hook the two outer fingers tilt rearwardly and the pleat pinching device is located below the lower ends of the fingers rather than at or above the lower ends of the fingers. By so locating the pleat pinching device, the extent to which the folds may be pinched together is in no way impaired by the tendency of the pleater hook fingers to spread the folds apart.

Other objects, features and advantages of the present invention will become apparent from the following description and accompanying drawings, in which.

Figure 5:
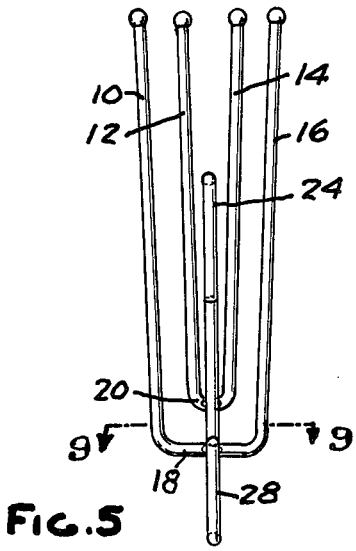
FIG. 5 is a rear elevational view of the pleater hook.
Figure 4:
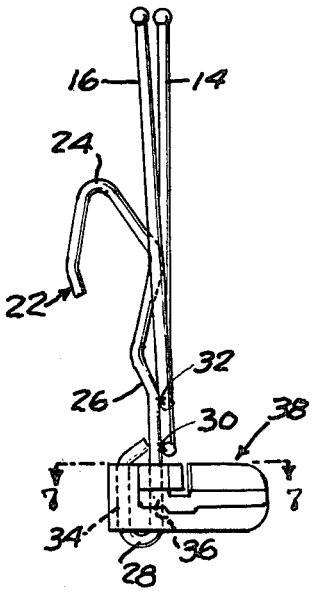
FIG. 4 is a side elevational view of the pleater hook with the pleat-pinching attachment mounted thereon.
Figure 6:
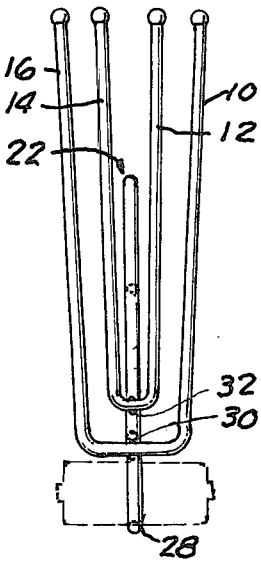
FIG. 6 is a front elevational view of the pleater hook.

Referring first to FIGS. 4 through 6, the drapery pleater hook of the present invention is preferably formed of wire and includes four fingers designated 10,12, 14,16. The two outer fingers 10,16 form the legs of a U and are interconnected by bight portion 18. Likewise, the two inner fingers 12,14 form the legs of a U that are interconnected by a bight portion 20. The pleater hook also includes a support hook member 22 having an inverted U-shaped upper end 24, a shank 26 and a closed loop lower end 28. In the preferred embodiment illustrated, the U formed by the outer legs 10,16 has a greater vertical extent that the U formed by the inner legs 12,14. Bight portion 18 is welded to shank 26 as at 30 and bight portion 20 is welded to shank 26 as at 32. It will be noted that the looped portion 28 extends downwardly below bight portion 18. As shown in FIG. 5, fingers 10,12,14,16 flare slightly outwardly in an upward direction. Likewise, as shown in FIG. 4, the two outer fingers 10,16 slope slightly rearwardly relative to the plane of the inner fingers 12,14 in an upward direction. The support hook 22 is disposed in a plane generally perpendicular to the plane of the fingers and the loop portion 28 thereof is preferably formed with two generally vertical, straight legs 34,36 which are spaced apart in the plane of support hook 22.

Figure 7:
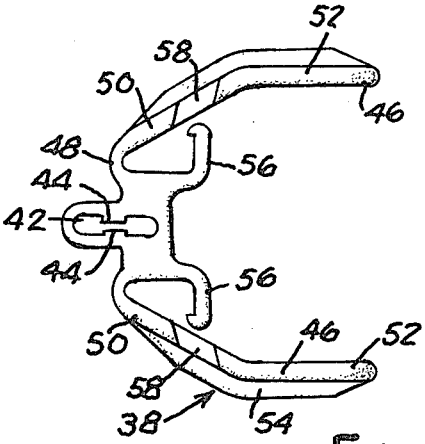
FIG. 7 is a plan view of the pleat pinching attachment in the open condition.
Figure 8:
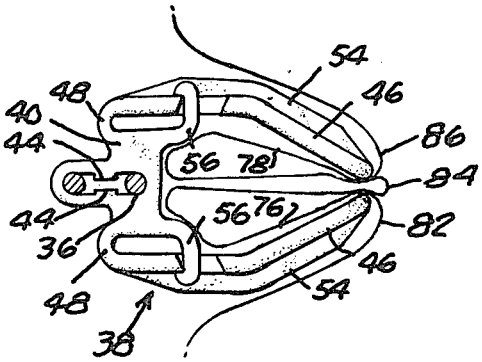
FIG. 8 is a view similar to FIG. 7 and showing the attachment in the closed clamping position.
Figure 10:
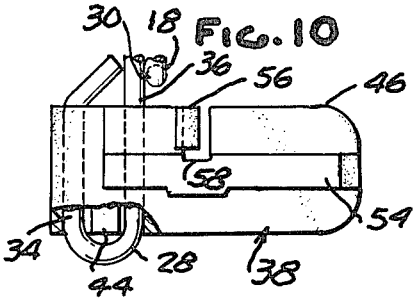
FIG. 10 is an enlarged fragmentary side elevational view of the pleater hook showing the pleat pinching attachment in the closed position.

The loop portion 28 of hook support 22 is adapted to receive a pleat pinching attachment generally designated 38. Attachment 38 is best illustrated in FIGS. 7, 8 and 10; it includes a body portion 40 provided with a vertical slot 42 for receiving the legs 34,36 of loop portion 28. At the central portion thereof slot 42 is formed with vertically extending abutments 44 which effectively reduce the width of the slot. After the attachment 38 is slipped upwardly on loop portion 28 the abutments 44 engage the loop portion 28 to firmly retain the attachment 38 on the hook as illustrated in FIG. 10.

Attachment 38 is, for reasons of economy, preferably formed as a molded plastic part. It includes two fingers 46 which are connected to body portion 40 by means of thin hinged sections 48 about which the fingers are flexible for swinging movement in a horizontal plane as viewed in FIG. 10. Each finger 46 is comprised essentially of two straight sections 50,52 which lie in vertical planes that are inclined to one another. Along their outer sides, fingers 46 are provided with strengthening ribs 54 which impart a desired stiffness or rigidity to the fingers. The body 40 of attachment 38 is also provided with a pair of laterally outwardly opposed hook members 56. Each finger 46 is provided with a slot 58 above the plane of ribs 54 which is laterally aligned with the hooks 56.

In FIG. 7 attachment 38 is illustrated with the fingers 46 in the opened position. In this position it will be noted that the straight portions 52 of the fingers are relatively widely spaced in generally parallel relation while the straight portions 50 converge toward each other in a direction rearwardly to the hinged sections 48. The hinged sections 48 enable fingers 46 to be swung inwardly toward each other to the position shown in FIG. 8. When the fingers 46 are so manipulated, hooks 56 pass through slots 58 and engage the outer sides of fingers 46 to retain them in the position shown in FIG. 8. In this condition it will be observed that the straight portions 52 of the fingers now converge toward one another at their outer free ends. Thus, in the closed position of the attachment the free ends of fingers 46 are locked in substantially contacting relation. It will be understood, of course, that hooks 56 are at least slightly flexible so that when fingers 46 are closed the hooks 56 snap into engagement with the fingers. By the same token, when the attachment is in the clamped locked position fingers 46 can be disengaged from hooks 56 by simply manually spreading them apart. The ease with which the fingers can be locked and unlocked is enhanced by the rigidity imparted to the fingers 46 by the strengthening ribs 54.

Figure 9:
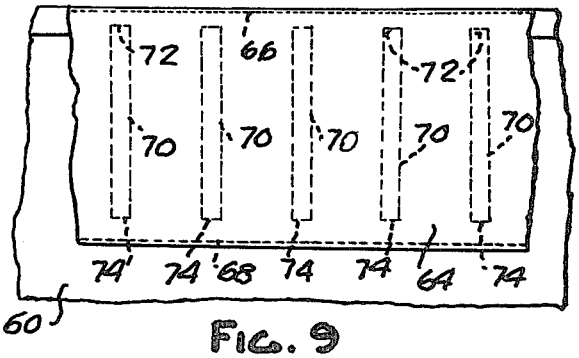
FIG. 9 is a fragmentary rear elevational view of a drapery with a strip of pleater tape sewn thereon.

The general type of drapery with which the pleater hook of the present invention is adapted to be used is illustrated in FIG. 9. The fabric drapery panel 60 has a folded hem 62 at its upper end. Hem 62 is at the rear side of the panel. A strip of pleater tape 64 formed of crinoline or the like is secured to the rear upper edge of panel 60 by stitching as at 66,68. Pleater strip 64 may be any one of several conventional types which are marketed commercially. It is formed with a plurality of pockets 70 which are spaced apart laterally of the pleater strip at a distance substantially greater than the lateral spacing of the fingers 10,12,14,16 of the pleater hook. Pockets 70 are closed at their upper ends 72 while the lower ends 74 of the pockets are open. In the pleater strip illustrated the open ends 74 of pockets 70 terminate above the lower edge of the pleater strip. While this arrangement is preferable, it is not essential.

Figure 11:
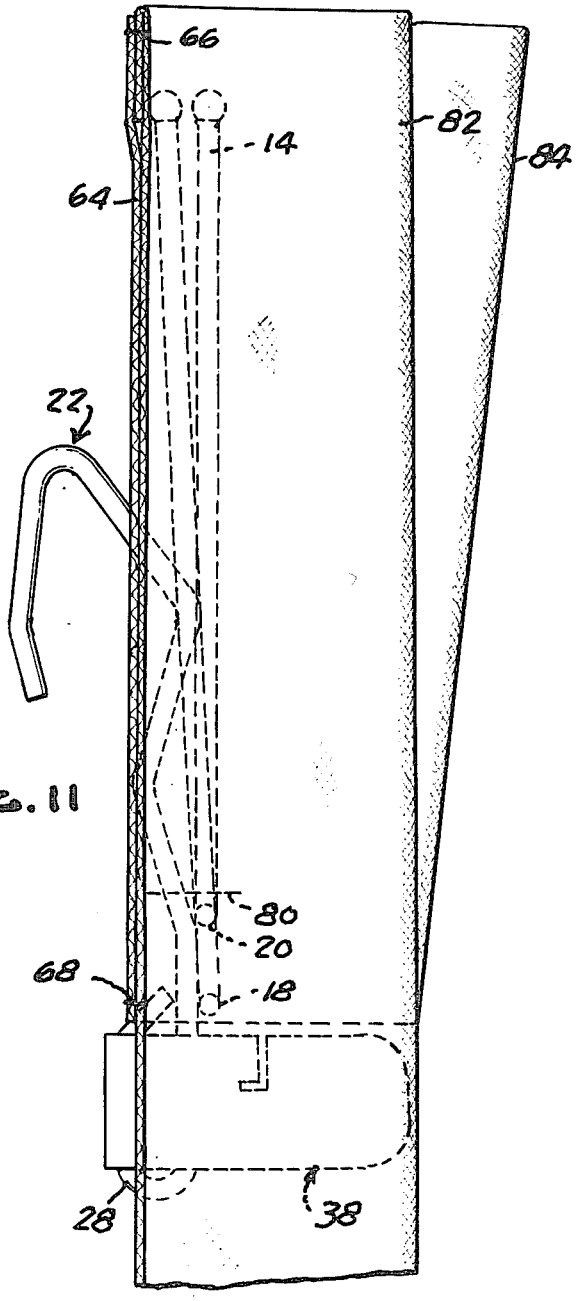
FIG. 11 is a sectional view along the line 11—11 in FIG. 1.

To engage the pleater hook with the pleater strip 64 the upper end of one of the fingers 10 or 16 is inserted upwardly slightly into the lower open end 74 of one of the pockets 70. Thereafter the drapery panel is progressively gathered so that the upper ends of the remaining fingers can be successively partially inserted into the lower ends of the next three pockets 70. After all of the fingers of the hook are partially inserted into four successive pockets 70, the gathered portion of the panel is manually grasped adjacent the lower edge of the pleater strip and pulled downwardly so that the fingers of the hook are fully inserted into the pockets 70. It will be understood that when the fingers of the pleater hook are being inserted into the pockets 70 of the pleater strip 64, fingers 46 of the pleat pinching attachment 38 are in the opened position illustrated in FIG. 7. As the drapery panel is pulled downwardly over the fingers of the hook the two inner folds 76,78 (FIG. 8) are guided between the open fingers 46. The gathered portion of the panel is drawn downwardly until the lower ends of the pockets 70 engage or are at the approximate level of bight portion 20 of the two inner fingers 12,14. In FIG. 11 the lower open ends 74 of pockets 70 are designated by the broken lines 80. The vertical extent of pockets 70 corresponds generally with the length of fingers 14,16 down to the bight portion 20.

Figure 1:
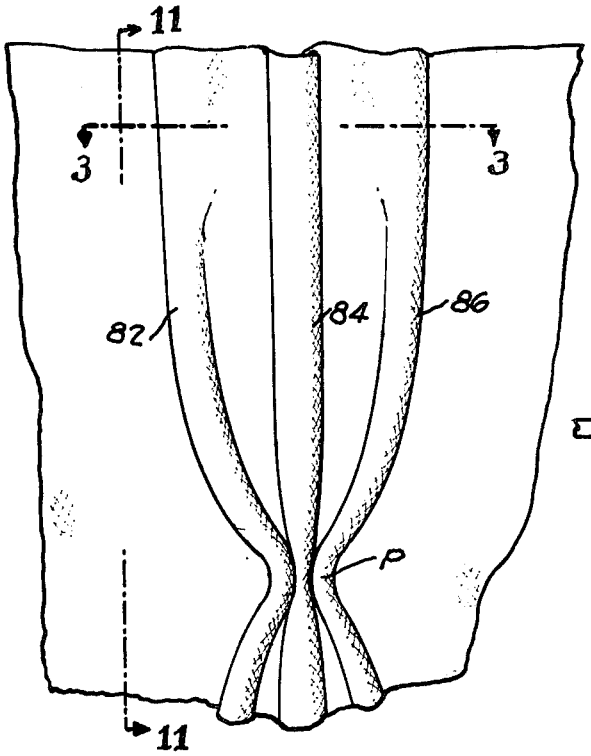
FIG. 1 is a fragmentary front elevational view of a drape having a pleat formed therein by means of the pleater hook of the present invention.
Figure 2:
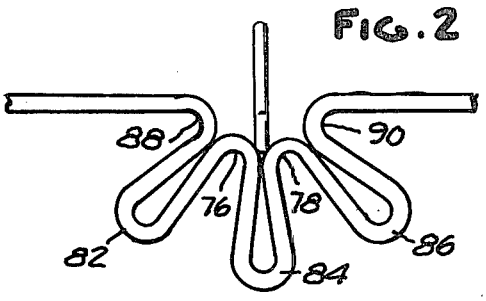
FIG. 2 is a top plan view of the pleated drapery shown in FIG. 1.

After the hook is inserted into the gathered drapery panel as described the fingers 46 are pressed together from the front side of the drapery panel to interengage the fingers with hook 56. This causes the two inner folds 76,78 to be tightly pinched together at the location of attachment 38 as shown in FIG. 8. As viewed from the front, the pleat thus formed has the appearance illustrated in FIG. 1. The portion of the pleat designated P provides a tight pinch resulting from the pinching action of attachment 38 in the locked condition illustrated in FIG. 8. Above the location P the two outer folds of the pleat flare outwardly in an upward direction. This is produced in part by the outwardly flared configuration of the pleater fingers and is greatly enhanced by the fact that the two outer fingers 10,16 are tilted rearwardly relative to the two inner fingers 12,14. As viewed from the top, the pleat thus formed has the appearance as shown in FIG. 2.

Figure 3:
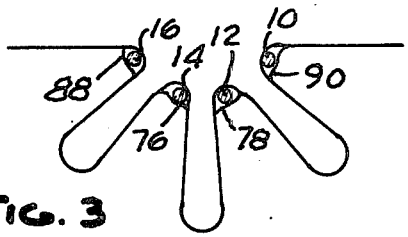
FIG. 3 is a sectional view along the line 3—3 in FIG. 1.

In FIG. 3 the relationship in position of the four fingers is clearly illustrated. In FIG. 3 the drapery fabric and the pleater strip have been shown, for purposes of illustration, generally as a single thickness, whereas in FIG. 11 the double fabric thickness at the upper end of the drapery is illustrated. The pleat thus formed has three outer folds 82,84,86 and four inner folds 76,78,88,90. The two outer folds 82,86 flare outwardly in an upward direction as shown in FIG. 1 while the center fold extends vertically and projects forwardly from the plane of the drape as shown in FIG. 11. Thus, the pinching action of attachment 38, its location on the pleater hook and the finger arrangement on the pleater hook impart the appearance of a custom-made plate. The tight pinching action is, of course, enhanced by the fact that attachment 38 is mounted on the hook at a level below the fingers of the pleater hook. Thus, the fabric pinched between the ends of fingers 46 is only the drapery fabric itself and not the double thickness above the attachment resulting from the application of the pleater strip 64 to the drapery panel.

The configuration of the pleater hook and pinching attachment 38 illustrated are preferred from the standpoint of manufacturing economy. It will be appreciated that both the hook and the attachment may have a configuration other than as shown and still produce the advantages of the illustrated arrangement in connection with the forming of a tightly pinched pleat which has the appearance of a custom-sewn pleat. For example, attachment 38 can be formed of wire or as a sheet metal stamping. Likewise, it will be appreciated that it is not essential that the bight portions 18,20 of the fingers be vertically spaced. In addition, the closed loop portion 28 of the supporting hook 22 can be disposed in a plane parallel to the plane of the pleater hook fingers rather than perpendicular thereto in which case the slot 42 in the body portion of the attachment would be disposed perpendicular to that illustrated in FIG. 7. If desired, the closed loop portion 28 could be formed as the bight portion of the two inner fingers 12,14 if the latter are extended downwardly below a bight portion 18 of the two outer fingers 10,16. The above variations are merely a matter of preference depending upon the type of equipment used to manufacture the hook and the attachment.

I claim:

1. In combination, a pleater hook for use with a drapery panel having a plurality of vertically extending pockets at the upper end thereof, the pockets being open at their lower ends, comprising, a series of four vertically extending, laterally spaced fingers all interconnected to one another in fixed relation adjacent their lower ends and adapted to be inserted upwardly into said pockets to form a pleat having three vertically extending folds at the upper ends of the drapery which project forwardly from the pleater hook, means attached to said fingers adjacent their lower ends and forming a rearwardly projecting support hook on the rear side of the pleater hook for suspending the pleater hook on a drapery rod, and a pleat pinching attachment fixedly supported on said hook and located below the interconnections between the lower ends of said fingers when in pleat pinching position, said attachment having a pair of relatively rigid arms thereon projecting forwardly of the pleater hook, said arms being swingable horizontally toward and away from each other between closed pleat pinching position and opened pleat receiving position, and releasable locking means on said attachment engageable with said arms for retaining them in said closed pleat pinching position, whereby, when the fingers are inserted into said pockets with said arms in the opened pleat receiving position and projecting forwardly into the two outer folds of the pleat with the center fold disposed therebetween, the arms are adapted to be swung inwardly toward each other and locked in said closed position by said locking means to tightly pinch and compress the three folds together at the location of said attachment below the interconnections between the lower ends of the fingers.

2. The combination called for in claim 1 including a rigid support member extending downwardly below said fingers, said attachment being mounted on said support member.

3. The combination called for in claim 1 wherein said arms in the closed position thereof converge toward each other in a forward direction with their free ends in substantially contacting relation.

4. A pleater hook as called for in claim 4 wherein said attachment includes a body portion and hinge means to which the rear ends of said arms are connected for permitting said swinging movement of the arms.

5. The combination called for in claim 5 wherein said arms are at least slightly resiliently flexible so that in the closed position thereof the outer ends are adapted to tightly pinch fabric folds of widely different thicknesses.

6. A pleater hook as called for in claim 5 wherein said locking means comprise releasable latch members.

7. The combination called for in claim 6 wherein said latch members are resiliently yieldable to disengage said arms when the arms are swung away from each other.

8. The combination called for in claim 6 wherein said latch members engage said arms at sections thereof which are more remote from the forward than the rearward ends of the arms.

9. The combination called for in claim 1 wherein said attachment comprises a one-piece plastic molded part having a body member from which said arms project forwardly, said arms being connected with said body member by means of weakened hinge sections.

10. The combination called for in claim 9 wherein said body member is formed with a pair of resilient latch members thereon adapted to releasably engage said arms when the arms are swung to the closed position.

11. The combination called for in claim 9 including an upright, generally U-shaped wire loop having a pair of legs connected by a bight portion extending downwardly from the lower end of said fingers, said body member having a vertically extending socket therein adapted to receive said loop to support the body member on the pleater hook.

12. The combination called for in claim 11 including yieldable abutment means in said socket engageable with the bight portion of said loop to releasably retain the body member on the loop.

13. In combination, a pleater hook for use with a drapery panel having a plurality of vertically extending pockets at the upper end thereof, the pockets being open at their lower ends, comprising a series of four vertically extending, laterally spaced fingers interconnected adjacent their lower ends and adapted to be inserted upwardly into said pockets to form a pleat having three vertically extending folds at the upper ends of the drapery wich project forwardly from the pleater hook, means attached to said fingers adjacent their lower ends and forming a support hook on the rear side thereof for suspending the pleater hook on a drapery rod, a rigid prong extending downwardly below the lower ends of said fingers, said prong being elongated in horizontal section, and a pleat pinching attachment having a vertically extending opening therein of elongated shape in horizontal section receiving said prong and retaining the attachment in fixed position on the pleater hook, said attachment having a pair of relatively rigid arms thereon projecting forwardly of the fingers, said arms being swingable horizontally toward and away from each other between closed and opened positions, and releasable means engageable with said arms for retaining them in said closed position, whereby, when the fingers are inserted into said pockets with said arms in the opened position and projecting outwardly into the two outer folds of the pleat with the center fold disposed therebetween, the arms are adapted to be swung inwardly toward each other to said closed position to tightly pinch the three folds together at the location of said attachment.

14. The combination called for in claim 13 wherein said prong comprises a generally U-shaped upright wire loop.

15. The combination called for in claim 12 wherein said loop comprises a downward extension of the lower end of said support hook.

16. The combination called for in claim 13 wherein said loop lies in a vertical plane extending transversely of the plane of said fingers.

* * * * *

UNITED STATES PATENT AND TRADEMARK OFFICE

CERTIFICATE OF CORRECTION

PATENT NO. : 4,170,053

DATED : OCTOBER 9, 1979

INVENTOR(S) : Philip ROSENZWEIG

It is certified that error appears in the above-identified patent and that said Letters Patent are hereby corrected as shown below:

| | |
|---|---|
| Column 5, Line 40 | "A pleater hook as called for in claim 4" should read -- The combination called for in claim 3 -- |
| Column 5, Line 44 | "claim 5" should read -- claim 4 -- |
| Column 5, Line 49 | "A pleater hook as called for in claim 5" should read -- The combination called for in claim 4 -- |
| Column 6, Line 53 | "claim 12" should read -- claim 14 -- |
| Column 6, Line 56 | "claim 13" should read -- claim 15 -- |

Signed and Sealed this

*Fifteenth* Day of *January 1980*

[SEAL]

*Attest:*

SIDNEY A. DIAMOND

*Attesting Officer*

*Commissioner of Patents and Trademarks*